US005853898A

United States Patent [19]

Obara et al.

[11] Patent Number: 5,853,898

[45] Date of Patent: Dec. 29, 1998

[54] THERMAL INK-TRANSFER RECORDING MATERIAL

[75] Inventors: Yuji Obara; Tetsuya Abe, both of Kanuma, Japan

[73] Assignee: Sony Chemicals Corp., Tokyo, Japan

[21] Appl. No.: 766,671

[22] Filed: Dec. 13, 1996

[30] Foreign Application Priority Data

Dec. 14, 1995 [JP] Japan ..... 7-347959

[51] Int. Cl.[6] ..... B41M 5/40

[52] U.S. Cl. ..... 428/488.4; 428/195; 428/474.4; 428/475.5; 428/484; 428/488.1; 428/913; 428/914

[58] Field of Search ..... 428/195, 484, 428/488.1, 488.4, 474.4, 475.5, 913, 914

[56] References Cited

FOREIGN PATENT DOCUMENTS 07-232483 9/1995 Japan ..... 428/195

*Primary Examiner*—Bruce H. Hess
*Attorney, Agent, or Firm*—Hill & Simpson

[57] ABSTRACT

In a thermal ink-transfer recording material comprising a base material, and a release layer and a thermal transferable ink layer which are superposingly formed thereon in this order, the release layer contains a wax, a rubber elastomer and a caprolactone oligomer, and the caprolactone oligomer is contained in the release layer in an amount of from 5% by weight to 25% by weight.

8 Claims, 1 Drawing Sheet

THERMAL INK-TRANSFER RECORDING MATERIAL

BACKGROUND OF THE INVENTION

1. Field of the Invention

This invention relates to a thermal ink-transfer recording material used to form thermal-transferred images.

2. Description of the Related Art

Thermal ink-transfer recording materials of a thermal melt transfer type are conventionally put into wide use when bar codes are printed on commodity tags or character information and image information produced by a personal computer or the like are printed on recording mediums such as paper.

Such thermal ink-transfer recording materials commonly comprise a base material such as polyester film and formed thereon a thermal transferable ink layer containing a wax as thermal transfer component. To thermally transfer image information to a recording medium through such a material, the thermal ink-transfer recording material is superposed on the recording medium in such a way that the thermal transferable ink layer of the former comes face to face in contact with the latter, and the thermal transferable ink layer is heated in accordance with image information by means of a thermal head set on the back of the base material, where molten portions of the layer are transferred to the recording medium, and the thermal ink-transfer recording material is peeled from the recording medium.

However, in the case of thermal ink-transfer recording materials formed of a base material and a thermal transferable ink layer directly formed thereon, resin materials used to constitute the base material have so low an affinity for the wax of the thermal transferable ink layer that there is the problem that good adhesion can not be achieved between the thermal transferable ink layer and the base material. This may cause come-off (an ink come-off phenomenon) due to a fold or elongation of the base material when the thermal ink-transfer recording material is set in a printer, or may cause a phenomenon of trailing in which, when the thermal ink-transfer recording material is peeled from the recording medium after thermal ink-transfer, not only the heated portion of the ink layer is transferred to the recording medium, but also a non-heated portion continuous to the heated portion is transferred as if it trails, in the direction where the thermal ink-transfer recording material is peeled. Especially in the winter season, where the environmental temperature falls, a phenomenon may also occur in which the thermal transferable ink layer separates from the base material.

Accordingly, in order to solve such problems, it is recently proposed to provide a release layer between the base material and the thermal transferable ink layer, which is capable of undergoing cohesive failure when peeled after thermal ink-transfer. For example, Japanese Patent Application Laid-open No. 4-78585 discloses mixing, in addition to the wax, a rubber elastomer not having a high affinity for the wax but having a good adhesion to various resin base materials, in order to improve the adhesion of the thermal transferable ink layer, and also, in order to improve its adhesion especially at low temperatures, forming the release layer using a composition mixed with a vinyl acetate/ethylene copolymer (EVA) that enhances the cohesive force of the ink layer.

Japanese Patent Application Laid-open No. 7-232483 also discloses forming the above release layer using a composition prepared by adding to the wax and the rubber type resin a caprolactone oligomer in place of the vinyl acetate/ethylene copolymer (EVA). In this instance, the caprolactone oligomer in the release layer is contained in an amount not less than 30% by weight.

Such a release layer undergoes cohesive failure at the time of thermal ink-transfer to cover the surface of transferred images, and is expected to improve the scratch resistance of the transferred images.

However, in the case when the release layer is formed using the wax, rubber elastomer and EVA as disclosed in Japanese Patent Application Laid-open No. 4-78585, the EVA, having a higher melt viscosity than the wax, has a good compatibility with the wax, so that the melt viscosity of the release layer increases at the time of thermal ink-transfer, bringing about the problem that the heated portion of the release layer does not undergo cohesive failure at the time of thermal ink-transfer. As the result, so-called sticking or jerking may occur, the former being a phenomenon in which the thermal transferable ink layer remains on the release layer without being transferred at all to the recording medium, and the latter a phenomenon in which the ink layer is intermittently transferred in streaks. The sticking or jerking may occur at a high frequency especially when the environmental temperature is high. In order to prevent the ink come-off at low temperatures, the rubber elastomer must be mixed in a larger quantity. In such an instance, however, the self cohesive force of the release layer may increase to cause an increase in adhesion, bringing about the problem that the release layer does not undergo cohesive failure. Hence, the thermal transferable ink layer remains on the release layer to cause faulty transfer such as blank areas in the images.

In the case when the release layer is constituted of the wax, the rubber type resin and the caprolactone oligomer contained in an amount not less than 30% by weight as disclosed in Japanese Patent Application Laid-open No. 7-232483, there is the problem that transferred images formed through the thermal ink-transfer recording material having such a release layer has a low optical density.

SUMMARY OF THE INVENTION

The present invention solves the above problems involved in the prior art. Accordingly, an object of the present invention is to provide a thermal ink-transfer recording material that can be free from the phenomenon of ink come-off or sticking, can retain a practical density of transferred images and also can impart a superior scratch resistance to the transferred images, when used at usual service environmental temperatures.

The present inventors have discovered that the above object can be achieved when the release layer is formed using a caprolactone oligomer in an amount within a specific range in place of EVA and also using this oligomer in combination with a wax and a rubber elastomer. Thus, they have accomplished the present invention.

More specifically, the present invention provides a thermal ink-transfer recording material comprising a base material, and a release layer and a thermal transferable ink layer which are superposingly formed thereon in this order, wherein;

the release layer contains a wax, a rubber elastomer and a caprolactone oligomer; the caprolactone oligomer being contained in the release layer in an amount of from 5% by weight to 25% by weight.

These and other objects, features and advantages of the present invention are described in or will become apparent from the following detailed description of the preferred embodiments.

DESCRIPTION OF THE PREFERRED EMBODIMENTS

Figure 1:
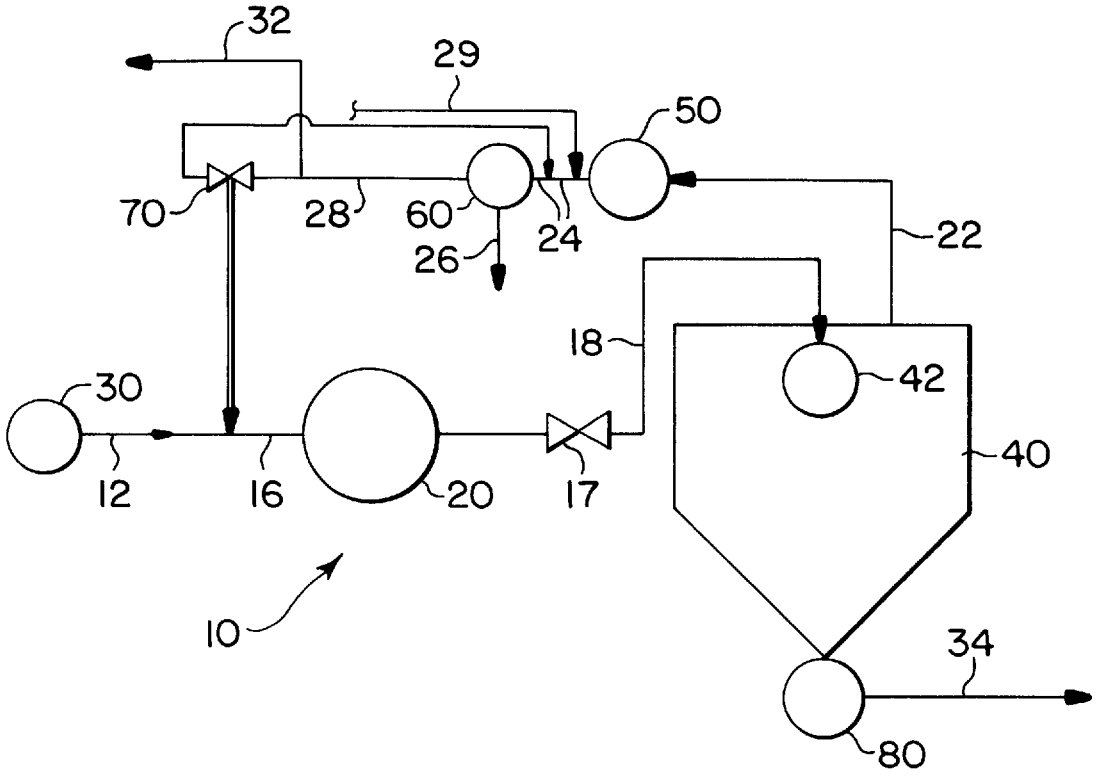
FIG. 1 is a cross section of the thermal ink-transfer recording material of the present invention.
Figure 1:
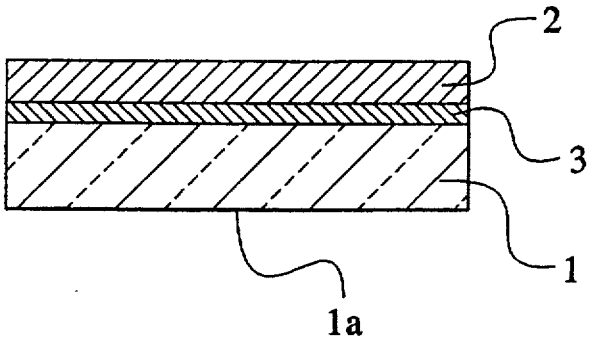

FIG. 1 illustrates the thermal ink-transfer recording material of the present invention. This recording material has a structure wherein a release layer 3 is provided between a base material 1 and a thermal transferable ink layer 2. In this recording material, the release layer is constituted chiefly of a wax, a rubber elastomer and a caprolactone oligomer. This makes it possible to greatly suppress the phenomenon of ink come-off or sticking at the time of thermal ink-transfer while retaining a practical density of transferred images, when used within a usual environmental temperature range (about 5° to 40° C.), and also to improve scratch resistance of the transferred images obtained.

The caprolactone oligomer used in the present invention is an oligomer obtained by subjecting ϵ-caprolactone monomers to ring-opening polymerization. Here, as the ϵ-caprolactone monomers, unsubstituted ϵ-caprolactone may be used, and modified ϵ-caprolactone monomers having a substituent such as a hydroxyl group or a carboxyl group may also be used. For example, ϵ-caprolactone diols or ϵ-caprolactone triols may be used. In this instance, e.g., two or more oligomers having different molecular weight or formed using different monomers may be used.

As the caprolactone oligomer, it is preferable to use those having a number average molecular weight of 10,000 or less, esp., when the content of caprolactone oligomer in the release layer is adjacent to the upper limit as described below. This is because those having a too large molecular weight may cause an increase in oligomers' internal cohesive force to make it difficult for the release layer 3 to undergo cohesive failure and hence the sticking or jerking may occur at the time of thermal ink-transfer.

The caprolactone oligomer may be contained in the release layer 3 in an amount of from 5 to 25% by weight, and preferably from 5 to 10% by weight. If it is contained in an amount less than 5% by weight, the sticking may occur in an environment of high temperature. If it is in an amount more than 25% by weight, the transferred images may have a optical density undesirably low enough to be questioned in practical use.

As the rubber elastomer used in the present invention, it is preferable to use those having an adhesive strength stability at a low temperature (e.g., about 5° C.). Such rubber elastomers may include compounded elastomers such as isoprene rubber, butadiene rubber, styrene-butadiene rubber, nitrile rubber, nitrile-butadiene rubber, butyl rubber, ethylene-propylene-diene rubber, chlorosulfonated polyethylene rubber, methylsilicone rubber, vinyl-methylsilicone rubber, phenyl-methylsilicone rubber, fluorinated silicone rubber, fluorinated vinylidene rubbers, and phosphazene rubbers; styrene rubbers such as styrene-butadiene-styrene rubber (SBS), styrene-isoprene-styrene rubber (SIS), and styrene-polyolefin(ethylene-butylene)-styrene rubber (SEBS); and polyolefin elastomers, polyester elastomers, polyamide elastomers, and vinyl chloride elastomers. In particular, styrene elastomers are preferably used in view of their low compatibility with the wax.

The rubber elastomer may be used in combination of two or more kinds.

The rubber elastomer may preferably be contained in the release layer 3 in an amount of from 1 to 20% by weight, and more preferably from 3 to 8% by weight, because its use in a too small amount tends to cause the ink come-off at low temperatures and its use in a too large amount tends to cause the sticking at the time of thermal ink-transfer.

As the wax used in the present invention, various types of waxes may be used which are conventionally used as thermal transfer components in thermal ink-transfer recording materials of a thermal melt transfer type. For example, at least one of natural waxes such as carnauba wax and candelila wax, and synthetic waxes such as polyethylene wax and paraffin wax may be used. In particular, in view of transferred image density and scratch resistance, it is preferable to use as the main component of the wax a wax having a penetration of preferably 2 or less, and more preferably 1 or less, as measured according to JIS 2235.

The wax may preferably be contained in the release layer 3 in an amount of from 70 to 95% by weight, and more preferably form 85 to 90% by weight, because its use in a too small amount may make the release layer thermally melt with difficulty to tend to cause a lowering of thermal ink-transfer performance and its use in a too large amount relatively makes the content of the caprolactone oligomer or rubber elastomer lower than the required amount.

The release layer 3 may be optionally incorporated with known additives as exemplified by plasticizers such as dioctylphthalate, surface active agents of various types, fillers of various types such as calcium carbonate and carbon, and thermoplastic resins such as polyester resins, acrylic resins, terpene resins, rosin type resins and petroleum resins.

The release layer 3 may preferably have a layer thickness of from 0.2 to 1.5 μm, and more preferably from 0.5 to 1.0 μm, because a release layer with a too small thickness may mix with the ink layer, and may cause the sticking or jerking especially when a binder is used which has a tackiness to the thermal transferable ink layer at the time of thermal ink-transfer, and a release layer with a too large thickness may cause a decrease in thermal response or transfer sensitivity and also make it impossible to stably prevent the ink come-off at the time of low-temperature transfer.

As the base material 1 used in the present invention, the same base materials as those used in conventional thermal ink-transfer recording materials of a thermal melt transfer type may be used. For example, polyester film, polyimide film, polysulfone film, polypropylene film, polycarbonate film, condenser paper and so forth may be used.

There are no particular limitations on the layer thickness of the base material 1. In usual instances, the base material may be 2 to 20 μm thick, and preferably from 4 to 7 μm thick.

The thermal transferable ink layer in the present invention may be constituted in the same manner as thermal transferable ink layers used in conventional thermal ink-transfer recording materials of a thermal melt transfer type. For example, it may be formed in such a way that a colorant such as carbon black, a wax such as carnauba wax or paraffin wax and a resin such as ethylene-vinyl acetate resin are uniformly mixed and dispersed and the mixture obtained is molded in the form of a layer.

The base material 1 of the release layer according to the present invention may be provided on its side 1*a* opposite to the release layer 3, with a heat-resistant lubrication layer formed of silicone resin or fluorine resin, in order to prevent a thermal head from sticking at the time of thermal ink-transfer to enable smooth transport of the thermal ink-transfer recording material.

The thermal ink-transfer recording material of the present invention can be produced by conventional methods. For example, the wax, the rubber elastomer and the caprolactone oligomer are uniformly mixed in a solvent such as toluene to prepare a release layer forming coating solution, the coating solution is coated on the base material on one side of which the heat-resistant lubrication layer has been formed, which solution is coated on the side where no heat-resistant lubrication treatment is applied, followed by drying to form the release layer, and a thermal transferable ink layer forming composition is further coated thereon, followed by drying to form the ink layer. Thus, the thermal ink-transfer recording material of the present invention is obtained.

The thermal ink-transfer recording material of the present invention can be used in the same way as conventional thermal ink-transfer recording materials of a thermal melt transfer type. For example, it may be set in a thermal printer having a thermal head, and is superposed on a recording medium such as paper in such a way that the thermal transferable ink layer of the former comes in face-to face contact with the latter, and the ink layer is heated in accordance with image information by means of the thermal head on the base material side so that transferred images are formed on the recording medium.

EXAMPLES

The present invention will be described below in greater detail by giving Examples.

Examples 1 to 10, Comparative Examples 1 to 6

The components of Examples and Comparative Examples as shown in Tables 1 to 3 were mixed, and 100 parts by weight of each mixture obtained and 560 parts by weight of toluene were uniformly mixed. Thus, release layer forming compositions of the respective Examples and Comparative Examples prepare were prepared.

TABLE 1

| | (% by weight) | | | | |
|---|---|---|---|---|---|
| | Example | | | | |
| Components | 1 | 2 | 3 | 4 | 5 |
| Carnauba wax*1 | 87.5 | 42.5 | — | 87.5 | 85 |
| Paraffin wax*2 | — | 42.5 | — | — | — |
| Montan wax*3 | — | — | 90 | — | — |
| SIS elastomer*4 | 7.5 | 5 | 5 | — | 5 |
| SBS elastomer*5 | — | — | — | 7.5 | — |
| Caprolactone oligomer*6 | 5 | 10 | 5 | 5 | 10 |
| Caprolactone oligomer*7 | — | — | — | — | — |

Table 1 Notes: (the same applies in Tables 2 to 4)
*1: Carnauba No. 2, available from Noda Wax K.K.; penetration (JIS 2235): 1 or less
*2: HNP-3, trade name; available from Nippon Seiro Co., Ltd.; penetration (JIS 2235): 6 or less
*3: HOECHST E-WAX, trade name; available from Hoechst Japan Ltd.; penetration (JIS 2235): 1.6
*4: Sytrene/isoprene/styrene copolymer, CALIFLEX TR1107P, trade name; available from Shell Japan Co.
*5: Styrene/butadiene/styrene copolymer, TOCHTEC H-1052, trade name; available from Asahi Chemical Industry Co., Ltd.
*6: PLAXEL HIP, trade name (number average molecular weight: about 10,000); available from Daicel Chemical Industries, Ltd.
*7: PLAXEL 220, trade name (number average molecular weight: about 2,000); available from Daicel Chemical Industries, Ltd.

TABLE 2

| | (% by weight) | | | | |
|---|---|---|---|---|---|
| | Example | | | | |
| Components | 6 | 7 | 8 | 9 | 10 |
| Carnauba wax*1 | 42.5 | 75 | 87.5 | 82.5 | 72.5 |
| Paraffin wax*2 | 42.5 | — | — | — | — |
| Montan wax*3 | — | — | — | — | — |
| SIS elastomer*4 | 5 | 5 | 2.5 | 2.5 | 2.5 |
| SBS elastomer*5 | — | — | — | — | — |
| Caprolactone oligomer*6 | — | — | — | — | — |
| Caprolactone oligomer*7 | 10 | 20 | 10 | 15 | 25 |

TABLE 3

| | (% by weight) | | | | | |
|---|---|---|---|---|---|---|
| | Comparative Example | | | | | |
| Components | 1 | 2 | 3 | 4 | 5 | 6 |
| Carnauba wax*1 | 85 | 90 | 90 | 85 | 65 | — |
| Paraffin wax*2 | — | — | — | — | — | — |
| Montan wax*3 | — | — | — | — | — | — |
| SIS elastomer*4 | 15 | — | — | — | 5 | — |
| SBS elastomer*5 | — | — | — | — | — | — |
| Caprolactone oligomer*6 | — | 10 | 5 | 5 | — | — |
| Caprolactone oligomer*7 | — | — | — | — | 30 | — |
| Ethylene/vinyl acetate copolymer*8 | — | — | 5 | 10 | — | — |

Table 3 Notes:
*8: SUMITATE MB-11, trade name; available from Sumitomo Chemical Co., Ltd.

The compositions thus obtained were each coated on a polyester film base material of 6 μm thick (available from Teijin Limited) on the back of which a heat-resistant lubrication layer had been provided, which were coated by means of a bar coater so as to be in a dried coating thickness of 1 μm each, followed by drying to form a release layer.

Next, the components shown in Table 4 were uniformly mixed to prepare a thermal transferable ink layer forming composition. The composition obtained was coated on the release layer by means of a bar coater so as to be in a dried coating thickness of 3 μm, followed by drying in a 100° C. oven to form a thermal transferable ink layer. Thus, thermal ink-transfer recording materials were produced.

Comparative Example 6 is an example in which the thermal transferable ink layer was directly formed on the base material without providing the release layer.

TABLE 4

| | Amount |
|---|---|
| Components | (parts by weight) |
| Carnauba wax*1 | 31 |
| Paraffin wax*2 | 20 |
| Carbon black*9 | 45.5 |
| Ethylene/vinyl acetate copolymer*10 | 4 |
| Polystyrene*11 | 10 |
| Polystyrene*12 | 20 |
| Toluene | 213 |

Table 4 Notes:
*9: MHI-209, trade name; available from Mikuni Color Works, Ltd.
*10: SUMITATE KA-31, trade name; available from Sumitomo Chemical Co., Ltd.
*11: ENDEX 155, trade name; available from Hercules Inc.
*12: CRYSTALEX 5140, trade name; available from Hercules Inc.

(1) Image quality test

The thermal ink-transfer recording materials obtained in the respective Examples and Comparative Examples were each set in a bar code printer (B-30, manufactured by Teck Co.), and bar codes were printed on labels (FASSON IC, trade name; available from Fasson Co.) under conditions of environmental temperature of 5° C., 25° C. or 40° C. at the time of printing. Image quality of the prints obtained was evaluated according to the following evaluation criteria. Results obtained are shown in Tables 5 and 6.

Whether or not "ink come-off" occurred during the printing at 5° C. and whether or not "sticking" or "jerking" occurred during the printing at 40° C. were also observed. Results obtained are shown together in Tables 5 and 6.

Image quality evaluation criteria

| Rank: | State |
|---|---|
| AA: | An instance where the image quality is superior to a control (quality of images obtained at 25° C. using the thermal ink-transfer recording material of Comparative Example 3) |
| A: | An instance where the image quality is substantially the same as the control. |
| B: | An instance where the image quality is slightly inferior to the control. |
| C: | An instance where the image quality is greatly inferior to the control. |

(2) Test on image density of prints

Images were printed in the same manner as in the above (1) image quality test, and image density (optical density) of prints obtained at 25° C. was measured using a Macbeth densitometer (TR924). Measurements thus obtained were evaluated according to the following evaluation criteria.

Results obtained are shown in Tables 5 and 6.

Image density evaluation criteria

| Rank | Optical density (OD) |
|---|---|
| AA: | $1.9 \leqq OD$ |
| A: | $1.8 \leqq OD < 1.9$ |
| B: | $1.7 \leqq OD < 1.8$ |
| C: | $OD < 1.7$ |

(3) Scratch resistance test

Images were printed in the same manner as in the above (1) image quality test except that K8TB, available from Teck Co., was used as the labels. Image surfaces of the prints obtained were rubbed 20 times with cotton cloth using a rubbing tester (AB-301, manufactured by Tester Sangyo K.K.) under application of a load of 800 g/cm$^2$. Next, optical density of the ink transferred from the printed images to the surface of the cotton cloth brought into contact with the prints was measured using a Macbeth densitometer (TR924). Measurements thus obtained were evaluated according to the following evaluation criteria.

Results obtained are shown in Table 5. The content of the caprolactone oligomer (CL) in the release layer of each Example and Comparative Example is also shown in Table 5.

Scratch resistance evaluation criteria

| Rank | Optical density (OD) |
|---|---|
| AA: | $OD \leqq 0.17$ |
| A: | $0.17 < OD \leqq 0.21$ |

-continued

| Rank | Optical density (OD) |
|---|---|
| B: | $0.21 < OD \leqq 0.26$ |
| C: | $0.26 < OD$ |

TABLE 5

| Evaluation items | Example 1 | 2 | 3 | 4 | 5 | 6 | 7 | 8 |
|---|---|---|---|---|---|---|---|---|
| Image quality | | | | | | | | |
| 5° C. print: | AA | A | A | A | AA | B | AA | B |
| Ink come-off: | No | No | No | No | No | No | No | No |
| 25° C. print: | AA | AA | A | AA | AA | AA | AA | AA |
| 40° C. print: | A | AA | AA | A | AA | AA | AA | AA |
| Sticking: | No | No | No | No | No | No | No | No |
| Image density | AA | A | A | A | AA | A | A | AA |
| OD: | 1.94 | 1.80 | 1.81 | 1.87 | 1.93 | 1.85 | 1.87 | 1.90 |
| Scratch resistance | AA | B | B | AA | A | B | AA | AA |
| OD: | 0.16 | 0.22 | 0.24 | 0.15 | 0.19 | 0.25 | 0.16 | 0.15 |
| CL (wt. %): | 5 | 10 | 5 | 5 | 10 | 10 20 | 10 | |

| Evaluation items | Example 9 | 10 | Comparative Example 1 | 2 | 3 | 4 | 5 | 6 |
|---|---|---|---|---|---|---|---|---|
| Image quality | | | | | | | | |
| 5° C. print: | A | A | AA | C | C | C | A | B |
| Ink come-off: | No | No | No | Yes | Yes | Yes | No | Yes |
| 25° C. print: | AA | AA | B | AA | A | A | AA | A |
| 40° C. print: | AA | AA | C | AA | B | C | AA | A |
| Sticking: | No | No | Yes | No | No | Yes | No | No |
| Image density | A | B | A | A | A | AA | C | A |
| OD: | 1.87 | 1.70 | 1.87 | 1.86 | 1.86 | 1.97 | 1.64 | 1.86 |
| Scratch resistance | A | A | A | A | AA | A | B | C |
| OD: | 0.21 | 0.21 | 0.18 | 0.20 | 0.17 | 0.21 | 0.23 | 0.30 |
| CL (wt. %): | 15 | 25 | 0 | 10 | 5 | 5 | 30 | 0 |

As is seen from the results shown in Table 5, in the case of the thermal ink-transfer recording material of Comparative Example 1, in which the release layer is formed using the wax and the rubber elastomer without using the caprolactone oligomer, images obtained in an environment of high temperature (40° C.) have a low image quality, and also the phenomenon of sticking is seen. In the case of the thermal ink-transfer recording material of Comparative Example 2, in which the release layer is formed using the wax and the caprolactone oligomer without using the rubber elastomer, images obtained in an environment of low temperature (5° C.) have a low image quality, and also the phenomenon of ink come-off is seen.

In the case of the thermal ink-transfer recording materials of Comparative Examples 3 and 4, in which the release layer is formed using the wax and the caprolactone oligomer and using EVA in place of the rubber elastomer, images obtained especially in an environment of low temperature have a low image quality, and also the phenomenon of ink come-off is seen.

As is also seen from the tables, in the case of the thermal ink-transfer recording material of Comparative Example 5, having a release layer containing the caprolactone oligomer in an amount of 30% by weight, transferred images have a low optical density, and in the case of the thermal ink-transfer recording material of Comparative Example 6, having no release layer, transferred images have a low scratch resistance.

On the other hand, in the case of the thermal ink-transfer recording materials of Examples 1 to 10, in which the release layer is formed using the wax and the rubber elastomer and using 5 to 25% by weight of the caprolactone oligomer, none of the evaluation items are evaluated as "C" as shown in Table 5, showing that the thermal ink-transfer recording materials are practical.

As described above, the thermal ink-transfer recording material of the present invention can be free from the phenomenon of ink come-off or sticking, can retain a practical density of transferred images and also can impart a superior scratch resistance to the transferred images, when used at usual service environmental temperatures.

What is claimed is:

1. A thermal ink-transfer recording material comprising:

a base material having a surface;

a release layer disposed on the surface; and a thermally transferable ink layer disposed on the release layer, said release layer comprising from about 70% to about 95% by weight of a wax, from about 1% to about 20% by weight of a rubber elastomer and from about 5% to about 25% by weight of a caprolactone oligomer, based upon the weight of said release layer.

2. The thermal ink-transfer recording material according to claim 1, wherein said caprolactone oligomer is an oligomer obtained by subjecting ϵ-caprolactone monomers to ring-opening polymerization.

3. The thermal ink-transfer recording material according to claim 2, wherein said ϵ-caprolactone monomers are ϵ-caprolactone diols or ϵ-caprolactone triols.

4. The thermal ink-transfer recording material according to claim 1, wherein said caprolactone oligomer has a number average molecular weight of 10,000 or more.

5. The thermal ink-transfer recording material according to claim 1, wherein said rubber elastomer is an styrene elastomer.

6. The thermal ink-transfer recording material according to claim 5, wherein said styrene elastomer is styrene-butadiene-styrene rubber, styrene-isoprene-styrene rubber, or styrene-ethylene-butylene-styrene rubber.

7. The thermal ink-transfer recording material according to claim 1, wherein said rubber elastomer is contained in said release layer in an amount of from 3% by weight to 8% by weight.

8. The thermal ink-transfer recording material according to claim 1, wherein said wax has a penetration of 2 or less as measured according to JIS 2235.

* * * * *

UNITED STATES PATENT AND TRADEMARK OFFICE

CERTIFICATE OF CORRECTION

PATENT NO. : 5,853,898

DATED : Dec. 29, 1998

INVENTOR(S) : Yuji Obara, et al.

It is certified that error appears in the above-identified patent and that said Letters Patent is hereby corrected as shown below:

At the Title Page, please delete the drawing and insert the attached drawing.

On the reverse side of the Title Page, please delete "FIG. 1" and insert --FIG. 1-- attached.

Signed and Sealed this

Fifth Day of October, 1999

*Attest:*

*Attesting Officer*

Q. TODD DICKINSON

*Acting Commissioner of Patents and Trademarks*

US005853898A

United States Patent [19]

Obara et al.

[11] Patent Number: 5,853,898

[45] Date of Patent: Dec. 29, 1998

[54] THERMAL INK-TRANSFER RECORDING MATERIAL

[75] Inventors: Yuji Obara; Tetsuya Abe, both of Kanuma, Japan

[73] Assignee: Sony Chemicals Corp., Tokyo, Japan

[21] Appl. No.: 766,671

[22] Filed: Dec. 13, 1996

[30] Foreign Application Priority Data

Dec. 14, 1995 [JP] Japan ..... 7-347959

[51] Int. Cl.[6] ..... B41M 5/40

[52] U.S. Cl. ..... 428/488.4; 428/195; 428/474.4; 428/475.5; 428/484; 428/488.1; 428/913; 428/914

[58] Field of Search ..... 428/195, 484, 428/488.1, 488.4, 474.4, 475.5, 913, 914

[56] References Cited

FOREIGN PATENT DOCUMENTS 07-232483 9/1995 Japan ..... 428/195

*Primary Examiner*—Bruce H. Hess
*Attorney, Agent, or Firm*—Hill & Simpson

[57] ABSTRACT

In a thermal ink-transfer recording material comprising a base material, and a release layer and a thermal transferable ink layer which are superposingly formed thereon in this order, the release layer contains a wax, a rubber elastomer and a caprolactone oligomer, and the caprolactone oligomer is contained in the release layer in an amount of from 5% by weight to 25% by weight.

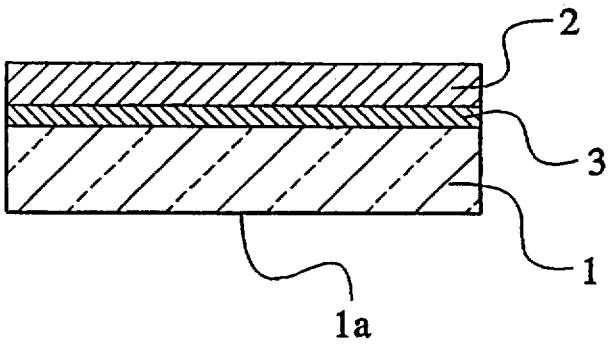

8 Claims, 1 Drawing Sheet